United States Patent [19]

Inoue et al.

[11] 4,140,613

[45] Feb. 20, 1979

[54] SEALED TERMINAL

[75] Inventors: Takeo Inoue; Takashi Shirasawa; Takeki Nishikori, all of Amagasaki, Japan

[73] Assignee: Mitsubishi Denki Kabushiki Kaisha, Tokyo, Japan

[21] Appl. No.: 823,099

[22] Filed: Aug. 9, 1977

[51] Int. Cl.[2] ..... C23F 13/00

[52] U.S. Cl. ..... 204/196; 174/152 GM

[58] Field of Search ..... 204/196; 174/152 GM, 174/152 R

[56] References Cited

U.S. PATENT DOCUMENTS 2,949,376 8/1960 Comer ..... 174/152 GM 4,039,417 8/1977 Sasaki et al. ..... 204/196

*Primary Examiner*—Howard S. Williams

*Attorney, Agent, or Firm*—Oblon, Fisher, Spivak, McClelland & Maier

[57] ABSTRACT

A sealed terminal of invention is used for a metal vessel containing water and has improved characteristics such as anticorrosive characteristics, water sealing characteristic and high mechanical strength and insulating characteristic. A terminal conductor of an auxiliary anode is seal-bonded in a terminal opening of the metal vessel with an insulator comprising mica and glassy material and which is softened at a temperature lower than about 900° C. and is plastic deformable under compression.

8 Claims, 8 Drawing Figures

FIG. 6
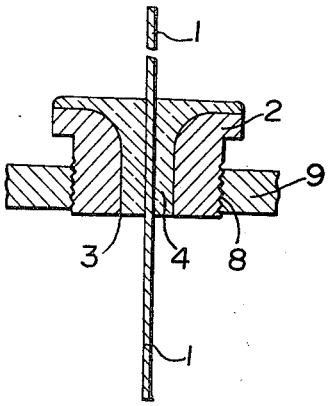
FIG. 8
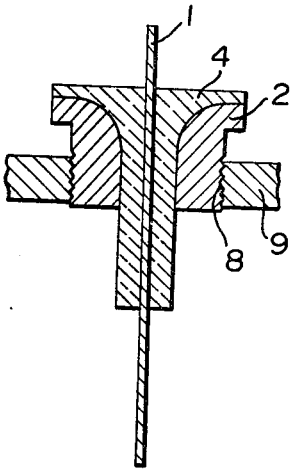
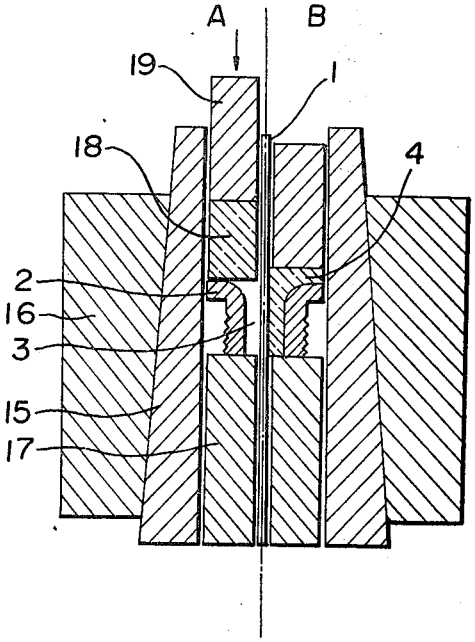
FIG. 7

SEALED TERMINAL

BACKGROUND OF THE INVENTION

1. Field of the Invention

The present invention relates to a sealed terminal having the improved anticorrosive characteristic and water sealing characteristic.

2. Description of the Prior Art

A sealed terminal has been widely used for various electric apparatuses which require air tightness or water sealing characteristics. The present invention will be illustrated in the case of an auxiliary anode which is used for electric hot water apparatuses.

Apparatuses for containing water include electric hot water apparatuses using electric power at night and hot water apparatuses using heat source of petroleum and gas. These hot water apparatuses have been widely used. A metal vessel is usually equipped in these hot water apparatuses and enamel coated vessels or stainless steel vessels have been used because of anticorrosive characteristic of the vessels.

These vessels usually have a closed structure having no opening and accordingly, they have a welded part. Even though stainless steel is used, the corrosion of the welded part is disadvantageously found. When an enamel coated plate is used, the uncoated part is always found at the welded part whereby the corrosion can not be prevented.

In general, metal dipped in water has a specific potential because of ionization of the metal. The potential is referred to as galvanic potential or corrosion potential, and the corrosion is caused by the corrosion potential. In order to prevent the corrosion, the current is fed from the other electrode for inhibiting the ionization of the metal. A galvanic anode system and an impressed current system have been known as the cathodic protection method in the principle.

In the former system, a metal which has lower corrosion potential and is easily ionized is electrically contacted to form an electric cell so as to provide a resulting suitable current. In the conventional hot water apparatus, the former system has been widely employed. A magnesium metal rod has been used as the galvanic anode. The galvanic anode requires a large surface area so as to generate current needed for the protection. When the vessel is large, it is necessary to use a magnesium metal rod having a larger diameter or to increase the number of the magnesium metal rods and, accordingly, the same is expensive. Sometimes, the magnesium metal rod is damaged by partial consumption whereby the protective effect is remarkably small or is disadvantageously not to be found. A further disadvantage is the dissolving of magnesium in water whereby the quality of water is inferior.

In the impressed current system, an electrode is inserted into the vessel containing water in simple structure whereby suitable power voltage is applied from the outside to form the anode and the current required for protection is obtained. When the vessel is larger, it is enough to control the potential so as to control the current and the number of the electrodes need not increase since the related cost is not as high as the galvanic anode system.

The latter system is excellent in overcoming the disadvantages of the life of magnesium metal rods such as the disappearance of the function caused by falling down or the change of quality of water caused by dissolving magnesium.

Although the impressed current system has a remarkable effect in principle, the system has not been practically applied because a sealed terminal or the electrode equipped in the sealed terminal has not yet been obtained.

The main characteristic required for the electrode is to have smaller consumption as the anode. The main characteristic required for the sealed terminal is to have enough insulation with respect to the vessel and to maintain the air-tightness or the water sealing characteristic as well as bearing high thermal shock. It is preferable to prevent the deterioration of characteristics of the sealed terminal and the electrode in aging. It is especially effective to use the electrode rod which is used as the terminal conductor of the sealed terminal in one piece structure so as to decrease the processing steps and to reduce the cost.

In order to satisfy the characteristics, the electrode rod used as the anode is preferably made of platinum which maintains perfect anticorrosive characteristic and the non-consumption characteristic, however, it is disadvantageously expensive. On the other hand, a metal coated with platinum such as a titanium wire coated with platinum has excellent anticorrosive characteristics and can be used under high current density and can be advantageously used as the electrode rod from the viewpoints of these characteristics as well as the cost.

On the other hand, the characteristics of the insulator for seal-bonding the terminal conductor and the sealing structure are important for the sealed terminal.

Referring to the drawings, the conventional embodiments will be discussed. FIGS. 1 to 4 are respectively the sectional views of the conventional embodiments of the sealed terminal used for the hot water apparatus.

In FIG. 1, the reference numeral (1) designates a terminal conductor which is also used as the electrode rod; (2) designates a substrate made of iron which has flange; (3) designates a terminal opening forward in the substrate; (4) designates an insulator which is inserted into the terminal opening and is made of porcelain for holding the terminal conductor (1) under insulation by the hole formed at the center; (5) and (5') respectively designate metallic film formed on the surface of the insulator; (6) designates a base metal which is welded with braze to the terminal conductor; (7) and (7') respectively braze for sealing the substrate (2), the insulator (4) and the terminal conductor by the welding; and (8) designates a screw formed outer surface of the substrate (2). In the conventional embodiment, the terminal conductor (1) is also used as the electrode rod. The reference (9) designates a metal vessel.

In the conventional sealed terminal, the metallic film (5), (5') or the base metal (6) is used for brazing the terminal conductor (1), the insulator (4) and the substrate (2). However, the disadvantage of limitation of the material is found because of the indispensable condition based on the difference of coefficients of linear expansion of the parts. For example, even though the titanium wire coated by the platinum plating which has an excellent anticorrosive characteristic is preferable as the terminal conductor (1), it could not be used in practice because the platinum coat is peeled off in the welding with braze. The base metal for welding and the braze (7') are disposed in the anode side to expose it to hot water, whereby the anticorrosive characteristic as the electrode is inferior. The anticorrosive characteristic is required only in the side of the terminal conductor (1) as the anode without the relation of the substrate (2) which is electrically insulated. The mutual connection of the substrate (2), the insulator (4) and the terminal conductor (1) is provided by the braze (7') through the metallic film (5) and the basic metal (6) for welding whereby the mechanical strength is disadvantageously quite low.

In the conventional embodiment shown in FIG. 2, the parts (1) and (4) to (9) are identical or corresponding to the parts in FIG. 1. The insulator (4) made of porcelain is held in sealing with a pair of packings (10), (10') and the screw (11) for fitting the packings. In the conventional embodiment of the sealed terminal having the above-mentioned structure, the disadvantages of the limitation of the material for welding with braze and the strength and the low anticorrosive characteristic caused by contacting the welded part with the hot water are also found to be the same as those of FIG. 1. Moreover, the number of the parts is increased so as to complicate the assembly.

In the conventional embodiment of the sealed terminal shown in FIG. 3, the parts (1), (2), (4) and (9) to (11) are identical or closely corresponding to the parts in FIG. 2. The reference (12) designates an electrode rod which is welded on the terminal conductor (1). In this case, Fernico is used as the terminal conductor (1) and the insulator (4) is made of glassy material which seals the terminal conductor (1) with the substrate (2). The substrate (2) is held on the body of the vessel through the packings (10) and (10') by the screw (11).

In the conventional embodiment, the material for the terminal conductor (1) is limited to Fernico etc. from the viewpoint of the coefficient of linear expansion. Even though the titanium wire coated by the platinum plating which has excellent anticorrosive characteristic is used as the electrode rod (12), the terminal conductor made of Fernico etc. is exposed into the hot water whereby the anticorrosive characteristic is inferior and many parts such as packings (10) are used disadvantageously.

In the conventional embodiment shown in FIG. 4, the parts (1) to (4), (8), (9) and (12) are identical or corresponding to the parts in FIG. 3. The references (13), and (13') respectively glassy sealing composition for seal-bonding the insulator (4) made of porcelain and the electrode rod (12) made of conductive ferrite, and for seal-bonding the insulator (4) and the substrate (2). The reference (14) designates a filler made of cured resin for fixing the connecting part between electrode rod (12) and the terminal conductor (1), at the terminal opening (3).

In the conventional embodiment, the electrode rod (12) made of the conductive ferrite has the anticorrosive characteristic being inferior to the titanium wire coated by the platinum plating but superior to the Fernico or the braze. However, the electrode rod (12) has inferior mechanical strength and thermal shock resistance whereby it it easily broken by slight shock at the assemble. When this is equipped in the hot water apparatus, this is easily broken near the contact to the insulator (4) by repeating the heating and cooling cycles. The electric resistance of the electrode rod is remarkably high in comparison with the other metals whereby disadvantageously the current is limited.

The necessity for improving insulation between the terminal conductor and the metal vessel will be explained as follows.

FIG. 5 is a schematic view for describing the principle of the outer power source system. In FIG. 5, the reference (20) designates a DC power source while (21) designates the welded part.

Even though the inner wall of the metal vessel (9) is coated with enamel, the metal is exposed at the welded part (21) so as to cause corrosion. In order to prevent the corrosion of the welded part (21), the terminal conductor (1) is disposed in the connection to the DC power source (20) to give positive potential to the metal vessel (9).

The characteristics required for the terminal conductor (1) are basic characteristics such as less consumption of the electrode, high thermal shock resistance, high mechanical strength and complete water sealing characteristic as well as easy assemble in the wall when it is used in practice. The reliability for extended time is quite important.

The most important problem with respect to reliability is the insulating characteristic between the anode and the cathode.

In such anticorrosive device, the terminal conductor (1) as the anode is disposed at the center and the substrate (2), being short-circuited to the cathode is disposed at the peripheral part and the insulator (4) is filled in the space. The substrate (2) is directly connected on the wall of the metal vessel (9).

The insulation resistance is mainly dependent upon the creeping resistance of the water-contacting surface of the insulator (4) disposed between the electrodes. From the viewpoint of reliability for long time, it is not true that the creeping resistance is considered to be the most important factor.

The reason for this will be described hereinafter. When the anticorrosive electrode is used for the vessel in the condition of complete control of water as a large boiler, there is less problem. However, when it is used for a house-hold hot water apparatus using electric power at night, the problem is serious. Various kinds of water is supplied to the hot water apparatus and water having high permanent hardness or temporary hardness is used, or water containing various ionized materials, whereby the material formed by the electrolysis is deposited around the electrodes. The deposited material has high electric conductivity whereby the insulation resistance between the electrodes is lowered. The phenomenon is dependent upon the time of use and is disadvantageous from the viewpoint of long reliability.

In the electrode structure shown in FIG. 5, the materials formed by the electrolysis are deposited on the peripheral parts (22) between the electrodes whereby the insulation resistance between the electrodes are decreased and the long period reliability is unsatisfactory.

SUMMARY OF THE INVENTION

It is the object of the present invention to overcome the disadvantages of the conventional sealed terminals.

The present invention provides a sealed terminal wherein a terminal conductor as an anticorrosive electrode is seal-bonded to a terminal opening formed in the metal vessel with an insulator which comprises main components of mica and a glassy material and which is softened at lower than about 900° C. and is plastic deformable under compression. It is not necessary to weld the terminal conductor with braze whereby the disadvantages of the limitation of the material and low mechanical strength for the welding with braze or the low anticorrosive property of the braze under contacting with hot water are experienced.

The present invention also provides a sealed terminal wherein the coefficient of linear expansion of the metal vessel is larger than that of the insulator comprising main components of mica and the glassy material with the coefficient of linear expansion of the insulator being larger than that of the terminal conductor, whereby the compressed force is always applied, from the outer side in the range of temperature, in the sealed terminal molded at high temperature and the sealing characteristics, especially the water sealing characteristic, are remarkably high.

The present invention also provides a sealed terminal wherein the insulator has an elastic characteristic so as to absorb mechanical shock because the mica powder has a fissility characteristic.

The present invention further provides a sealed terminal wherein the insulator is projected into the metal vessel whereby the creeping distance between the terminal conductor and the metal vessel is long and the insulation between the terminal conductor and the metal vessel is improved.

BRIEF DESCRIPTION OF THE DRAWINGS

Various other objects, features and attendant advantages of the present invention will be more fully appreciated as the same becomes better understood by reference the following detailed description when considered in connection with the accompanying drawings in which like reference characters designate like or corresponding parts throughout the several views, and wherein:

FIG. 6 is a sectional view of one embodiment of a sealed terminal according to the present invention;

FIG. 7 is a sectional view for illustrating an assembly of the sealed terminal of the present invention; and FIG. 8 is a sectional view of the other embodiment of the sealed terminal of the present invention.

DETAILED DESCRIPTION OF THE PREFERRED EMBODIMENT

Figure 1:
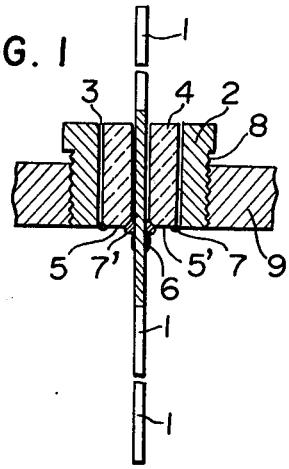
FIGS. 1 to 4 respectively show sectional views of the conventional sealed terminals.
Figure 2:
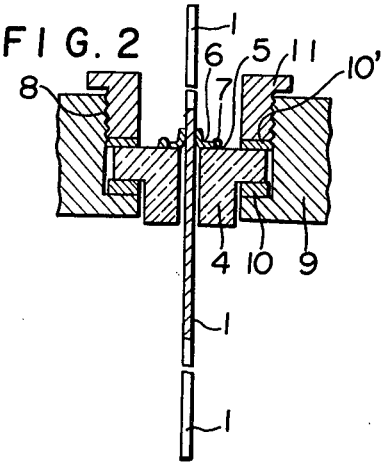
(PRIOR ART) FIG. 2
Figure 3:
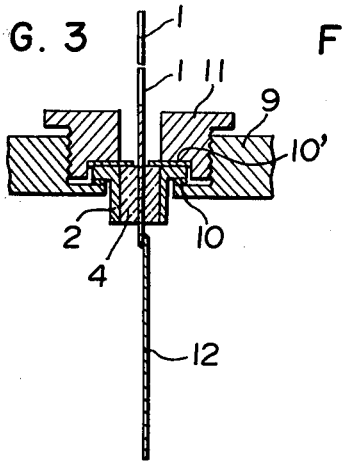
(PRIOR ART) FIG. 3
Figure 4:
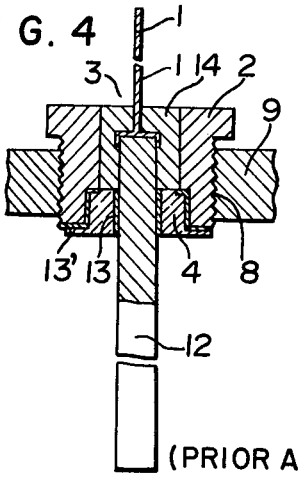
(PRIOR ART) FIG. 4

In FIG. 6 which is a sectional view of one embodiment of the present invention, the parts (1) to (4) and (8) and (9) are identical or correspond to parts of the embodiments of the conventional sealed terminals.

The terminal conductor (1) is a titanium wire coated by platinum plating and the substrate (2) is made of iron. The terminal conductor (1) and the substrate (2) are seal-bonded with an insulator (4) made of mica-glass composition containing main components of glassy material and mica which is softened at lower than about 900° C. and is plastic deformable under compression and can effectively seal-bond the terminal conductor (1), the substrate (2), and which is not critical.

When the terminal of the present invention is used as an anti-corrosive electrode of a hot water apparatus which is used for drinkable hot water, it is necessary to prevent a dissolution of toxic components as well as to maintain heat resistance and water leak resistance. The inventors have found that a glaze of enamel can be effectively used as the glassy material used in the above-mentioned purpose whereby the present invention has been accomplished. The preparation of the sealed terminal shown in FIG. 6 will be explained hereinbelow.

FIG. 7 is a sectional view of one embodiment for preparing the sealed terminal of the present invention. In FIG. 7, the parts (1) to (4) are identical parts to that shown in FIG. 6. The reference numeral (15) designates three divided walls; (16) designates a frame for holding the walls; (17) designates anvil which holds a terminal conductor (1), the substrate (2) and the insulator (4) which is molded under compression, in the cylindrical space formed by the walls; (18) designates a pre-shaped composition which contain main components of the glassy material and the mica; (19) designates a push rod which compresses the pre-shaped composition in the arrow line direction. The pressed mold is formed by the parts (15) to (19).

The left half part (A) of FIG. 7 shows the condition wherein the pre-shaped composition (18) is not compressed. The right half part (B) of FIG. 7 shows the condition wherein the pre-shaped composition (18) is compressed by the push rod (19) so as to bond the terminal conductor (1) and the substrate (2) in a sealed relationship.

The pre-shaped composition (18) can be obtained by using 40 wt. parts of glaze of enamel for an iron vessel which does not contain a toxic component such as lead, cadmium, and barium to dissolve in water and has a standard sintering temperature of about 800° C. and is pulverized to less than 200 mesh pass, and 60 wt. parts of artificial fluorine-containing phlogopite having 60 to 200 mesh and adding water to the mixture in wet condition and molding the wet composition by a press-molding in a cylindrical shape having a central hole to which the terminal conductor (1) is inserted.

For example, the pre-shaped composition (18) having an outer diameter of 30 mm and an inner diameter of the hole of 3 mm is prepared by compressing it under the pressure of 7 tons. The resulting pre-shaped composition is kept in an electric furnace at 85° C. for 10 minutes.

On the other hand, the pressed mold shown in FIG. 7 is formed by heating the assembly at about 400° C. and inserting the substrate (2) heated at about 450° C. in the other electric furnace, into the space and setting the pre-shaped composition (18) heated at 850° C. for 10 minutes, the terminal conductor (1) heated at 450° C. and the push rod (19) rapidly as shown in the left hand part (A) of FIG. 7 and compressing the push rod (19) under the total pressure of 15 tons. When the compression is carried out, the pre-shaped composition (18) can be converted into the insulator made of the mica-glass molded product as shown in the right hand part (B) of FIG. 7 whereby the terminal opening (3) is completely filled and the substrate (2) and the terminal conductor (1) are sealed. The compressed condition is maintained for 3 minutes. Then, the mold is disassembled to take out the molded product of the sealed terminal.

The sealed terminal prepared by the preparation of the present invention is in the condition of a sintered fitting for fastening the terminal conductor (1) and the insulator (4) by the substrate (2) under the difference of thermal expansion of the materials, whereby excellent sealed characteristics can be attained.

The pre-shaped composition (18) fed into the terminal opening (3) of the substrate (2) under the pressure at elevated temperature has the molten glassy material which is changed in the solid condition by cooling it at a temperature lower than the transition temperature (about 400° C. in the above-mentioned example).

The coefficients of linear expansion from about 400° C. to room temperature are respectively $11.5 \times 10^{-6}$ for the substrate (2); $9.5 \times 10^{-6}$ for the insulator (4) and $8.8 \times 10^{-6}$ for titanium as the terminal conductor (1). The coefficient of linear expansion of the outer part is higher than those of the inner parts.

In the sealed terminal molded in the condition at the elevated temperature, the compressed force is always applied from the outer substrate (2), in the range of the temperature in the use of the apparatus whereby the sealed characteristic, especially the water sealed characteristic, is excellent.

From the viewpoint of the anticorrosive characteristics, the sealed terminal can be prepared without causing any damage to the plated surface coated on the terminal conductor (1). Moreover, the insulator (4) can be prepared by using the glassy material such as a glaze of enamel which can be coated on mica having an excellent anti-corrosive property and on the surface of a body of the hot water apparatus whereby excellent anticorrosive property can be attained.

It is unnecessary to carry out the soldering or the welding with braze, whereby the terminal conductor (1) can be effectively used as the anticorrosive electrode rod. The glassy material which does not contain a component for lowering a melting point such as lead, cadmium or barium-component, can be effectively and advantageously used from the viewpoint of the toxicity.

From the viewpoint of the thermal shock and the mechanical shock, the mica used in the insulator (4) has fissility property whereby the insulator has elastic characteristic and has superior impact strength in comparison with those of porcelain or glass.

The strength for removing the insulator (4) made of the mica-glass molded product shown in FIG. 6 was measured to be higher than about 1.5 tons and there was found to be no problem with regard to thermal shock. Moreover, the temperature for heating the substrate (2) can be low, such as about 450° C., whereby the deformation is not caused in the molding at the elevated temperature under compression and the formation of thick oxide membrane on the surface is not found. Accordingly, the screw (8) for fixing it to the vessel can be formed before the molding operation whereby the same can be economically obtained.

In the above-mentioned example, the titanium wire coated by the platinum plating was used as the terminal conductor. Thus, the terminal conductor can be a metal or other conductive material having a relatively small coefficient of linear expansion, especially having a coefficient of linear expansion smaller than that of the insulator (4) made of the mica-glass molded product.

The glassy material is not limited to the glaze of enamel and the mica is not limited to the artificial fluorine-containing phlogopite.

A substrate (2) made of iron was used. Thus, the substrate made of a material having a coefficient of linear expansion higher than that of the insulator (4) such as bronze or stainless steel can be effectively used. The substrate (2) can be a part of the apparatus such as the wall of the body of the vessel.

Figure 5:
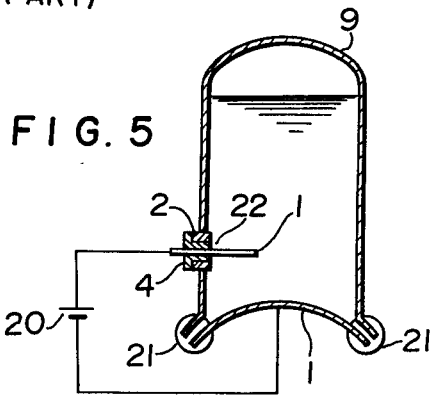
(PRIOR ART) FIG. 5
FIG. 5 is a schematic view for illustrating the principle of anticorrosive apparatus of a metal vessel in an outer power source system.

The insulator (4) shown in FIG. 8 is different from those of FIGS. 1 to 6. The insulator (4) is projected into the metal vessel (9) and the terminal conductor (1) is projected through the insulator (4) into the metal vessel (9). The terminal conductor (1) and the metal vessel (9) are connected to a DC power source as shown in FIG. 5.

In accordance with the sealed terminal having the above-mentioned structure, the distance between the terminal conductor (1) as the anode and the outer fitting as the cathode is large whereby the surface resistance between both electrodes is high and the potential density is low. Accordingly, the velocity of the electrolysis for forming in water is remarkably low. Even though the formation in the electrolysis is caused in use over a long period of time, the distance between both electrodes is too long and the lowering of the insulation resistance is small. The fatal defect of the lowering of the insulation resistance which has been found in the conventional embodiments are completely overcome and long term reliability has thus been attained.

The use of the sealed terminal of the present invention as the anticorrosive electrode for the hot water apparatus has been illustrated. However, the sealed terminal can be used as the other insulating terminals.

As illustrated, in the present invention, the terminal conductor is seal-bonded with the insulator of the mica-glass composition which is softened at lower than 900° C. to provide excellent anticorrosive characteristics, water sealing characteristics and impact strength.

Obviously, numerous modifications and variations of the present invention are possible in light of the above teachings. It is therefore to be understood that within the scope of the appended claims, the invention may be practiced otherwise than as specifically described herein. In the case of the outer power source system for anti-corrosion of a metal vessel, the insulator is projected into the metal vessel whereby the deterioration of the insulating characteristics between the metal vessel and the terminal conductor can be prevented.

What is claimed is:

1. A sealed terminal for mounting in a vessel which comprises:
   - a terminal conductor comprising titanium coated by platinum plating;
   - an insulator comprising mica and a glassy material including a terminal opening disposed therein and within which said terminal conductor is seal-bonded; and,
   - a substrate member comprising iron interconnecting said insulator and said vessel and including a screw formed outer surface which operatively engages said vessel.

2. A sealed terminal according to claim 1 wherein the coefficients of linear expansion of said substrate, said insulator and said terminal conductor are respectively lower in said order.

3. A sealed terminal according to claim 2, wherein the coefficient of linear expansion from 400° C. to room temperature is $11.5 \times 10^{-6}$ for the substrate, $9.5 \times 10^{-6}$ for the insulator, and $8.8 \times 10^{-6}$ for the terminal conductor.

4. A sealed terminal according to claim 1 wherein said glassy material is glass which does not substantially contain lead, cadmium and barium.

5. A sealed terminal according to claim 1 wherein said mica comprises artificial phlogopite fluorine.

6. A sealed terminal according to claim 1 wherein said terminal conductor is adapted for application of positive electrical potential and said substrate is adapted for application of negative electrical potential.

7. A sealed terminal according to claim 6 wherein said insulator is disposed so as to project from said terminal opening to the inner direction of said substrate.

8. A sealed terminal according to claim 1, wherein said glassy material comprises glaze of enamel.

* * * * *